US005791823A

United States Patent [19]

Blakley et al.

[11] Patent Number: 5,791,823

[45] Date of Patent: Aug. 11, 1998

[54] YIELDING HEAD FOR MINE SUPPORT

[75] Inventors: Ian Thomas Blakley; John Frederick Dyke; Allen Meston; Robert William Smith; David Gordon Nicholls; Helena Miu-Kwan Tsoi, all of Thompson, Canada

[73] Assignee: Inco Limited, Toronto, Canada

[21] Appl. No.: 761,488

[22] Filed: Dec. 6, 1996

[51] Int. Cl.[6] ..... E21D 21/02

[52] U.S. Cl. ..... 405/259.1; 405/259.6; 405/288

[58] Field of Search ..... 405/259.1, 302.2, 405/259.6, 259.5; 411/8, 9, 10, 5, 1–3

[56] References Cited

U.S. PATENT DOCUMENTS

| | | | |
|---|---|---|---|
| 4,156,236 | 5/1979 | Conkle | 340/690 |
| 4,382,719 | 5/1983 | Scott | 405/259 |
| 4,560,305 | 12/1985 | Powondra | 405/209 |
| 4,954,018 | 9/1990 | Gauna | 405/259 |
| 5,375,946 | 12/1994 | Locotos | 405/259 |
| 5,387,060 | 2/1995 | Locotos | 405/259 |

FOREIGN PATENT DOCUMENTS

| | | |
|---|---|---|
| 2202600 | 9/1988 | United Kingdom . |
| 8904911 | 6/1989 | WIPO . |

*Primary Examiner*—Dennis L. Taylor
*Attorney, Agent, or Firm*—Edward A. Steen

[57] ABSTRACT

A yielding head for reducing the need to recondition a rock mass. The yielding head includes a mine hole cradle and a longitudinally movable bar therein. The bar, which is connected to an extension bolt, is registered with a collapsible bubble serrated yielding element circumscribing the bar. As the rock mass is displaced the bar is drawn into the mine hole. The yielding element absorbs the stress on the bar in a controlled manner.

11 Claims, 3 Drawing Sheets

YIELDING HEAD FOR MINE SUPPORT

TECHNICAL FIELD

The instant invention relates to underground excavations in general, and more particularly, to a flexible reinforcement support for mine roofs.

BACKGROUND ART

In hard rock mines, the rock mass often rapidly deforms. As a result, conventional support systems fail quickly. The support systems currently in use are very strong. Because of their rigidity they cannot deform in the same manner as the rock mass.

Due to safety concerns, when the support fails the ground must be reconditioned. Reconditioning is expensive, time consuming, and the failed support is usually replaced with another rigid system.

There are a number of yielding support systems currently on the market. Apparently designed for the coal industry, with its relatively softer ground, some of these systems have not successfully coped with the harder ground conditions found in hard rock mines. Experience has shown that current yielding supports are unsatisfactory.

One major difficulty with an available flexible cable bolt was its failure to effectively mix the resin used to anchor the cable in the hole.

This failure lead to the conclusion that instead of considering a support system that would yield along the entire length of the support, the instant yielding head was designed so that it could be easily attached to a conventional rigid bolt.

Experience has shown that stoppers and jacklegs can provide an effective resin anchored rigid extension bolt with an elastic limit of about 31 tons ($2.76\times10^5$N) with failure occurring at about 38 tons ($3.38\times10^5$N).

A number of different yielding configurations were explored and discarded:

1) Yielding metal cylinder: A metal cylinder or pipe was placed over a section of the bolt. The load would increase until a catastrophic failure was experienced. The capacity of the cylinder would decrease below acceptable limits.
2) Metal spring: Since springs can increase in strength as the load increases it was thought that a spring based system would work. The highest capacity spring that can be easily handled by a single person has a peak load of less than 5 tons ($4.45\times10^4$N). There are no commercially available springs with a higher peak load limit having an acceptable size and weight.
3) Polyurethane bushings disposed in steel pipe: High load levels were experienced but with less than 1 inch (2.54 cm) displacement. The pipe itself would deform. To be useful, it was ultimately determined that about a six inch (15.24 cm) collapse stroke distance is required. A modification was attempted with stress relief holes drilled into the pipe. As expected, the polyurethane extruded out through the holes decreasing the load capacity.
4) A commercial anchor head for tunnels: This anchor has a modified U-shape design. The device had a very flat failure curve which the instant inventors feel is unacceptable. It will allow the rock mass to accelerate as the bolt yields.

There is a need for a yielding yet strong support system for bolts that reduces the need for reconditioning the ground in hard rock mines.

SUMMARY OF THE INVENTION

Accordingly, there is provided a yielding head that is capable of withstanding the enormous stresses caused by hard rock deformation. A tubular yielding element, made with a plurality of external rounded bulges, circumscribes a bar that is associated with an uphole rock bolt.

As the ground deforms, the bar is drawn into the hole collapsing the yielding element. The bar is capable of experiencing a six inch (15.24 cm) travel stroke.

PREFERRED MODE FOR CARRYING OUT THE INVENTION

Figure 1:
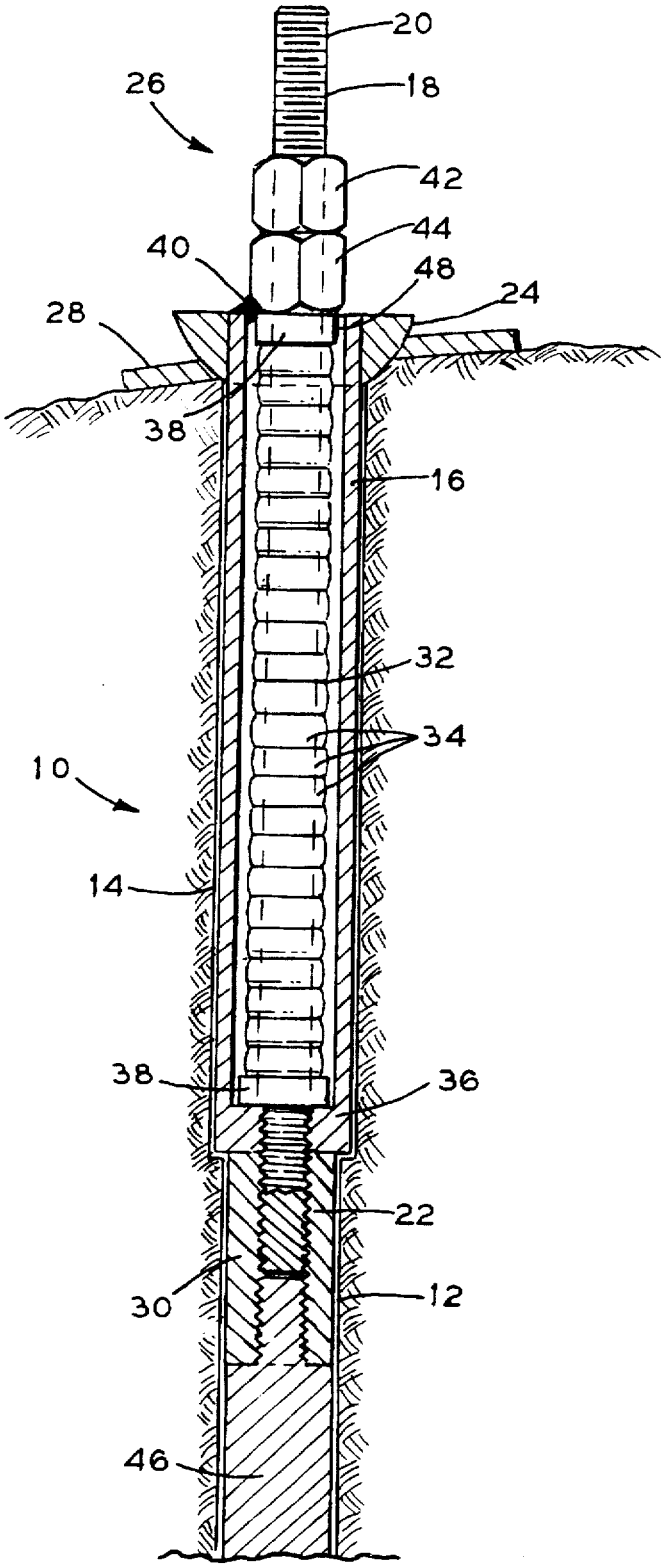
FIG. 1 is a cross-sectional elevation of an embodiment of the invention.

FIG. 1 shows a yielding head 10 in a mine hole 12. The mine hole 12 has a reamed section 14 that has a larger diameter than the diameter of the mine hole 12.

Figure 3:
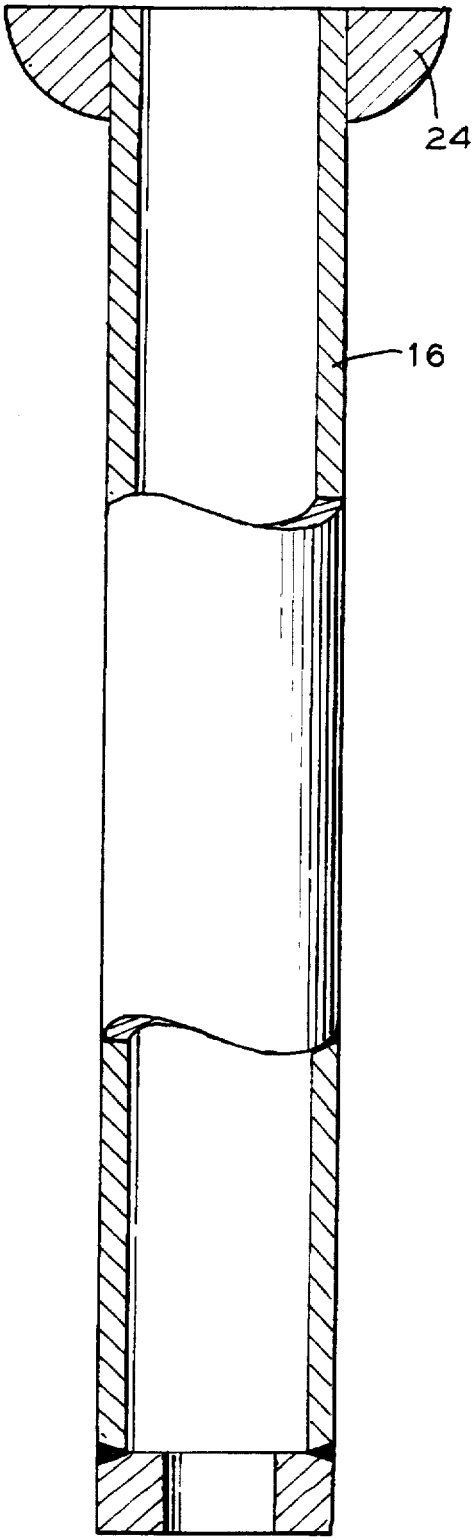
FIG. 3 is a cross-sectional elevation of the cradle.
Figure 4:
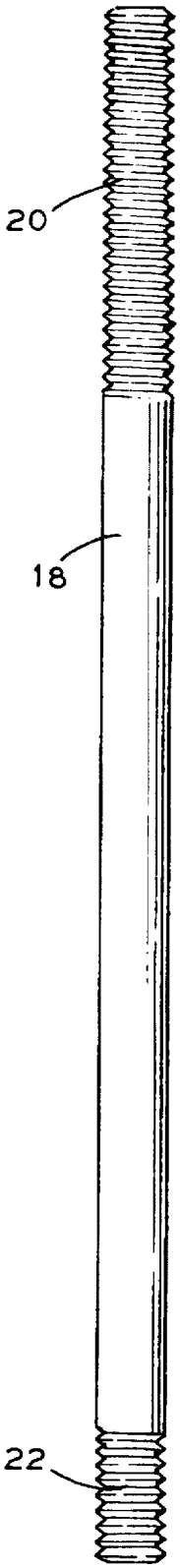
FIG. 4 is a cross-sectional elevation of the bar.

The yielding head 10 consists of a cradle 16 (See FIG. 3) circumscribing a solid bar 18 (See FIG. 4). The bar 18 is threaded at both ends 20 and 22. An integrated spherical seat 24 is affixed to the cradle 16 at the proximal or mine face end 26. A beveled plate 28 ensures a satisfactory fit between the seat 24 and the collar of the mine hole 12.

The distal threaded end 22 of the bar 18 is threadably connected to a coupler 30 which in turn is affixed to a standard 1 inch (2.54 cm) diameter 16 foot (4.9 m) long extension bolt 46. The extension bolt 46 includes to a rock bolt (not shown) further in the hole 12. Note how the reamed section 14 accommodates the diameter of the cradle 16.

Figure 2:
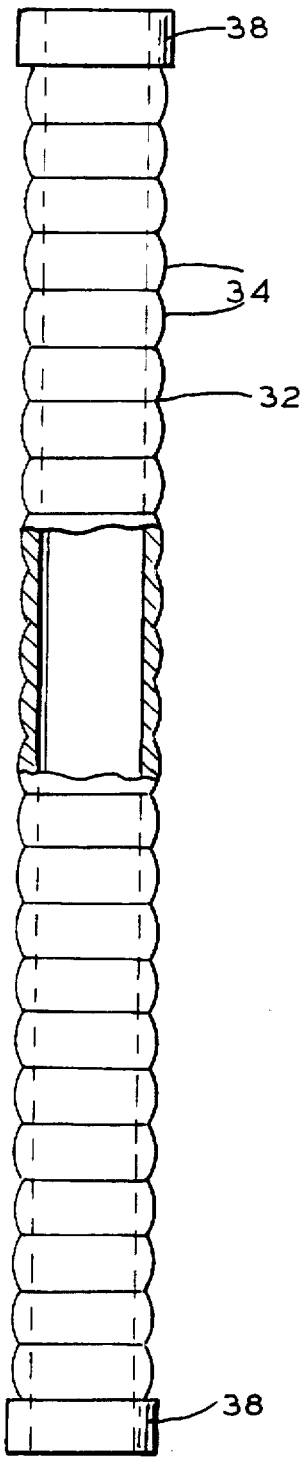
FIG. 2 is an elevation of the yielding head.

A yielding element 32 having a plurality of annular bubble serrations 34 circumscribes the bar 18 within the cradle 16. (See FIG. 2.) The distal reinforced end 38 of the yielding element 32 abuts against a land section 36 of the cradle 16.

A breakaway tack weld 40 maintains the bar 18, cradle 16 and the proximal reinforced end 48 of the yielding element 32 intact. A pair of strengthened nuts 42 and 44, preferably Fraser-Jones™ origin, are utilized to secure the yielding head 10 in position.

Figure 6:
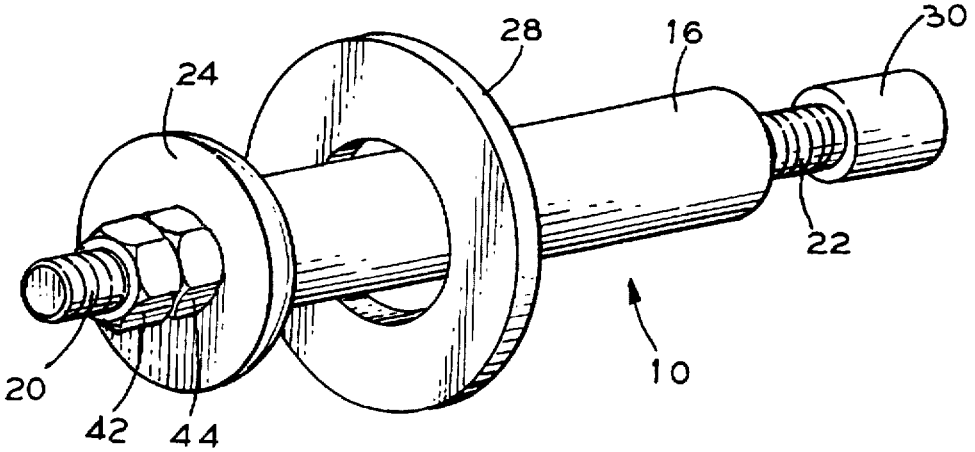
FIG. 6 is a perspective view of an embodiment of the invention.

FIG. 6 depicts the yielding head 10 in a perspective view.

As a result of the technical dead ends discussed above, in order to attain the desired peak load it was determined that a deformable metal element would be necessary. It was also clear that the element would have to be designed to induce controlled failure. This would allow uniform deformation and even load capacity.

Initially, scored tapered cylinders were used to circumscribe a rock bolt bar. After some promising attempts with a sharply serrated hose joiner resulted in an initial deformation of 8 tons ($7.12\times10^4$N) and full compression at 29 tons ($2.5840^5$N) with 5 inches (12.7 cm) of displacement, the instant invention took shape.

During testing of the serrated element it was noted that the various metal elements would always tend to form bulges perpendicular to the compression direction. It was decided that any new design would need to "facilitate" this bulging to occur. The new design used a series of round or bubble bulges 34 instead of the straight serrated indentations.

Figure 5:
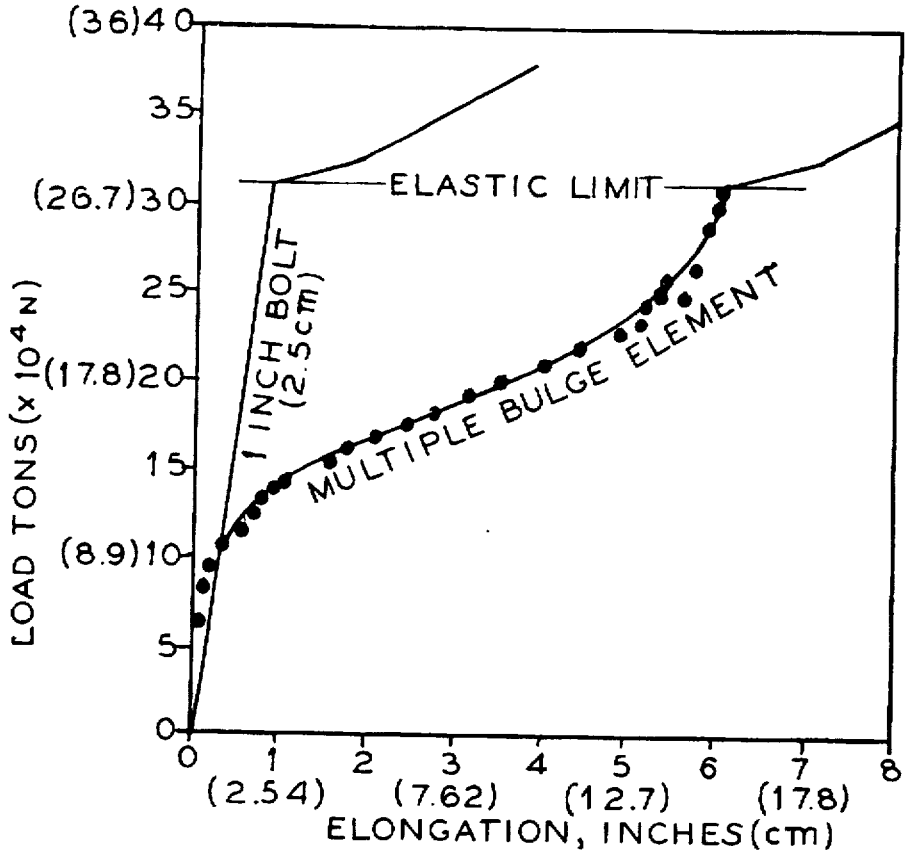
FIG. 5 is a load vs. elongation curve for the instant invention.

The yielding element 32 was constructed from 1 inch (2.54 cm) diameter seamless steel pipe. When tested, the element 32 yielded in a consistent and controlled manner with no significant drops in load. The element 32 started to collapse at approximately 10 tons ($8.9\times10^4$N) and appeared to be fully compressed at approximately 28 tons ($2.49\times10^5$N). The test results are shown in FIG. 5. Continued testing of several prototypes showed similar results. All yielding elements 32 followed the same elongation curve, with longer elements allowing for extra compression. Through continued testing of various length elements it was determined that a 12 inch (30.5 cm) long yielding element 32 was required to reach the desired goal of 6 inch (15.2 cm) displacement. Imperfections in the manufacturing process and in the steel pipe appeared to have no significant effect on the results. Once the element 32 has completely yielded, the underlying load characteristics of the rock bolt resumed.

To prevent damage and to support the yielding element 32 it was necessary to construct the cradle 16. The strength of the cradle 16 is designed to exceed the plastic limit of the 1 inch (2.54 cm) extension bolt 46. The cradle 16 required the spherical seat 24 to allow for rotation at the collar of the hole 12 as bolt holes are rarely parallel to the rock face. In the instant design the spherical seat 24 forms the collar portion of the cradle 16 eliminating the need for a separate lip. By combining these two pieces weight and the number of components were reduced.

The beveled plate 28 was designed to accommodate the large diameter of the cradle 16. The annular plate 28 is used to reduce weight and the inside hole is machined to accommodate the spherical seat 24.

To connect the head 10 to the bolt a coupling short bar is required because the bolt 46 will not fit inside the yielding element 32. Accordingly, the bar 18 is connected to the bolt 46 with a coupling 30 of the same material and size as a normal bolt coupler but with a different thread type to accommodate the threads at the end of the bolt 46.

The two nuts 42, 44 are strengthened Fraser-Jones break away nuts originally designed for rebar installations. These nuts 42, 44 slide into the collar as the element 32 collapses and exceed the load limits of the bolt 46.

The yielding element 32 and the bar 18 are coated in diamond drill and rod grease to prevent corrosion. Any corrosion of this element may alter the load characteristics of the head. The element is tack welded 40 to the top of the cradle 16 to keep it centered after the bar 20 and the yielding element 32 are greased.

The yielding head 10 is designed to be attached to the conventional 1 inch (2.54 cm) extension bolt 46 via the coupler 30. The hole 12 is drilled 13 inches (33.02 cm) longer and the first 13 inches (33.02 cm) of the hole 12 is reamed 14 with a cut bit to 2.25 inches (5.72 cm). A normal resin anchor may be used in the hole.

A Fraser-Jones dolly is used to install the extension bolt 46 with installation similar to a normal extension bolt. The yielding head 10 has been double nutted 42, 44 so that the resin anchor can be mixed. Final tightening of the bolt is done by removing the extra nut 42 and tightening.

The physical parameters presented herein are preferred examples only. It should be understood that by varying the dimensions, compositions and heat treatment of the components, different values may be obtained.

The following table lists a preferred component composition:

TABLE

| Component | Steel Type | Supplier |
|---|---|---|
| Yielding Element (32) | SMLS HSR pipe ASTM A106 GR B/ASME SA 106 GR B REG | Medallion Pipe Supply Ltd. Saskatoon, Saskatchewan, Canada |
| Integrated Spherical Seat (24) | CSA G40.21M 350W Mild Steel Plate | |
| Cradle (16) | ASTM A513-94, 1026, ERW, Type 5 SR, AW, Mechanical Tubing GRADE 1026/228MC HT: Stress Relieve | Alliance Tubular Products Alliance, Ohio, U.S.A. |
| Bar (18) | ASTM A434 90A CLBD BHN 311/352, Grade 4340 Heat Treat: Q/TEMP/SR Finish Cond: HR MS Product Quality: COM. QUAL. Melting Process: VAD | Atlas Specialty Steels Welland, Ontario, Canada |
| Plate (28) | CSA G40.21m 350w Mild Steel Plate | |
| Coupler (30) | AISI 1045 Steel | |

At least 6 inches (15.24 cm) of displacement can be achieved with the head 10 attached to the extension bolt 46. Compression of the yielding element 12 is achieved at about 32 tons ($28.5\times10^4$N) which is below the elastic limit of the bolt 46. This is not expected to affect the performance in underground applications.

Because of the consistency in the displacements with specific loads, the yielding head 10 can be used to accurately determine the load on the bolt by simply measuring the amount of compression of the head 10. This has a number of applications ranging from load monitoring of the surrounding rock mass to assessing the need for reconditioning. As the bar 18 is withdrawn into the cradle 16 due to rock mass deformation, a calibration relationship between the load and the distance withdrawn may be determined. By measuring the length of the bar 18 still extending from the cradle 16 an evaluation of the ground conditions and status can be easily made.

The instant yielding support system will allow significantly more ground movement than conventional rigid support systems currently used. This will be achieved while continuing to provide sufficient support to the rock mass as it moves preventing unexpected ground falls. The yielding head 10 will in many cases reduce reconditioning costs as the instant support system will continue to be effective after the conventional more rigid systems have failed.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follow:

1. A yielding head adapted to be connected to a bolt comprising a cradle adapted to be inserted into a mine hole, a bar having a proximal end and a distal end movably disposed within the cradle, a stress relieving collapsing tube circumscribing the bar, the tube including a plurality of bubble serrations disposed about the periphery thereof, means for affixing the bar to the bolt, and means for maintaining the yielding head in a generally fixed relationship with the mine hole.

2. The yielding head according to claim 1 wherein the bar is affixed to a coupler.

3. The yielding head according to claim 1 including a coupler affixed to the distal end of the bar.

4. The yielding head according to claim 1 wherein the yielding element has reinforced end.

5. The yielding head according to claim 4 wherein the reinforced end abuts an end of the cradle.

6. The yielding head according to claim 1 including a plate circumscribing the cradle and a proximal spherical seat circumscribing the cradle and adjacently disposed to the plate.

7. The yielding head according to claim 1 including at least one nut affixed to the bar.

8. The yielding head according to claim 1 wherein a breakaway weld is affixed to the cradle.

9. The yielding head according to claim 1 wherein a diameter of the cradle is larger than a diameter of the mine hole.

10. The yielding head according to claim 1 wherein the stress relieving collapsing tube absorbs a load at a smooth controlled predetermined rate.

11. The yielding head according to claim 1 wherein under a load the bar travels into the mine hole a predetermined distance.

* * * * *